US006573854B1

(12) United States Patent
Hug et al.

(10) Patent No.: US 6,573,854 B1
(45) Date of Patent: Jun. 3, 2003

(54) ERGONOMIC REMOTE CONTROL

(76) Inventors: Philippe Hug, La Grand Charrière, 1453 Bullet (CH); Anne B. Scheim, Ch. du Croset 1, 1024 Ecublens (CH)

( * ) Notice: Subject to any disclaimer, the term of this patent is extended or adjusted under 35 U.S.C. 154(b) by 0 days.

(21) Appl. No.: 09/567,116

(22) Filed: May 8, 2000

(51) Int. Cl.[7] ..... G08C 19/36

(52) U.S. Cl. ..... 341/176; 200/5 R; 200/9; 200/18

(58) Field of Search ..... 341/176; 200/5 R, 200/9, 18, 513; 340/825.72, 825.69; 348/734; 359/142, 146, 148; 455/151.1, 151.2

(56) References Cited

U.S. PATENT DOCUMENTS

| | | | | | |
|---|---|---|---|---|---|
| 4,322,587 | A | * | 3/1982 | Burns et al. | 200/302.1 |
| 4,626,848 | A | * | 12/1986 | Ehlers | 340/825.57 |
| 4,825,200 | A | * | 4/1989 | Evans et al. | 340/825.56 |
| D328,463 | S | | 8/1992 | King et al. | |
| D331,058 | S | | 11/1992 | Morales | |
| D344,952 | S | | 3/1994 | Bartholomew | |
| 5,414,426 | A | * | 5/1995 | O'Donnell et al. | 341/176 |
| 5,457,448 | A | | 10/1995 | Totsuka et al. | |
| 5,481,256 | A | | 1/1996 | Darbee et al. | |
| D380,449 | S | | 7/1997 | Palatov | |
| 5,675,427 | A | | 10/1997 | Miller | |
| 5,764,179 | A | * | 6/1998 | Tsurumoto | 341/176 |

FOREIGN PATENT DOCUMENTS

| | | | |
|---|---|---|---|
| GB | 2281138 | * | 2/1995 |
| WO | WO 94/01844 | | 1/1994 |

* cited by examiner

*Primary Examiner*—Michael Horabik
*Assistant Examiner*—Hung Dang
(74) *Attorney, Agent, or Firm*—Richard C. Litman

(57) ABSTRACT

A pistol-shaped television remote control unit, including an infrared light emitting diode (LED) and circuitry for transmitting control signals to an infrared detector in the television receiver, and a microprocessor which retains the last six channels selected in memory. The ergonomic design provides a plurality of conveniently activated switches, including a trigger which changes the channel to the channel previously selected, three volume control switches on the inside of the grip (volume up, down and mute) for convenient operation by the middle, ring and little fingers, a function keyboard on the back of the grip, and picture adjustment buttons on the side of the grip. The power switch is located on an angled portion of the back of the grip. Power to the unit is provided by batteries which are loaded into the barrel of the device by means of a threaded cap at the muzzle.

5 Claims, 8 Drawing Sheets

ERGONOMIC REMOTE CONTROL

BACKGROUND OF THE INVENTION

1. Field of the Invention

The present invention relates to remote control devices for electrical and electronic appliances, and particularly to an ergonomically shaped infrared remote control device for operating a television set, the device having a housing in the shape of a pistol.

2. Description of the Related Art

Remote control devices for television sets and other electronic devices fall into two broad categories: those which are hard wired to the appliance, and those which transmit an electromagnetic wave, usually in the infrared portion of the spectrum, which is received and decoded by the appliance. The infrared devices generally comprise a housing having one or more buttons or switches which serve as the user interface, one or more integrated circuits (usually a central processor unit (CPU), often accompanied by a ROM (read only memory) or EPROM (erasable and programmable read only memory) to translate the user command to a digital or binary signal, an infrared light emitting diode (LED) and associated driver circuitry, a power source (usually batteries), and, optionally, a visible LED to signal the user when the remote control unit has power and/or is transmitting. The infrared LED typically emits a series of binary signals distinguished by the time duration of, or between, bursts of pulses, usually in the millisecond range. Infrared remote control units for television sets often emit infrared signals at a different frequency than remote control units for videocassette recorders (VCRs) in order to avoid conflict between the two devices, as they are frequently sold as separate but interconnecting units.

Remote control units vary in their perceived utility, convenience, and functionality. The prior art shows devices which are intended to perform a myriad of functions, some including as many functions as by direct entry on the set itself, and other devices which are intended to perform only a limited number of functions. Many remote control units have a rectangular parallelepiped shape with differing numbers of buttons having different sizes, shapes, and functions, while a few remote control units alter the shape of the housing itself to enhance its usefulness to the user.

Several pistol shaped remote control units are shown in U.S. Design Patents, such as U.S. Des. Pat. No. 328,463 issued Aug. 4, 1992 to King, et al. (pistol grip but without barrel and without function keyboard but with two infrared emitters), U.S. Design Pat. No. 331,058 issued Nov. 17, 1992 to Fernando Morales (pistol grip but with the grip and barrel at an obtuse angle and an infrared LED with a broad, elongated, convex diffusion lens), and U.S. Design Pat. No. 344,952 issued Mar. 8, 1994 to David A. Bartholomew (with an IR LED at the end of the barrel and a function keypad at the hammer or slide end of an automatic pistol).

U.S. Pat. No. 5,675,427, issued Oct. 7, 1997 to Johnny D. Miller, describes a pistol shaped remote control unit having the circuitry in the grip, the batteries in the barrel, an IR transmitter at the muzzle end, a power switch, mute switch, a first trigger having two membrane switches for channel up-down, and a second trigger having two membrane switches for volume up-down. The Miller device has no keypad for direct entry of the channel or other information. United Kingdom Patent No. 2,281,138, published Feb. 22, 1995 discloses a pistol shaped remote control unit having a channel up-down rocker switch for a trigger, a 3-position (volume up-down-mute) switch for the hammer, a power switch for a safety, and a function keypad on the side of the barrel. The power source for this device is in the grip and the IR transmitter is at the muzzle end.

Examples of other ergonomically shaped or multifunction remote control units include U.S. Des. Pat. No. 380,449, issued Jul. 1, 1997 to Dennis Palatov (shaped like an exercise grip, with or without knurls); U.S. Pat. No. 5,457,448, issued Oct. 10, 1995 to Totsuka, et al. (unit with round, weighted bottom so it always stands upright, with minimal number of keys); U.S. Pat. No. 5,481,256, issued Jan. 2, 1996 to Darbee, et al. (includes a scan function to scan channels); and International Patent WO 94/01844, published Jan. 20, 1994 (has a function keypad with geometrical shapes corresponding to the function or number).

While television is a remarkable technological advance performing a myriad of communications functions from information dissemination to entertainment, nevertheless, its effect on viewers is often aggravating and objectionable, sometimes due to the proliferation of advertising, and at other times due to program content. Viewers frequently feel the need for emotional release, commonly satirized in cartoons and television situation comedies by the angry viewer who puts his foot through the television screen or picks up a gun and shoots it. Channeling such anger into less destructive behavior may partly explain the popularity of pistol shaped remote control units, particularly in the United States where handguns have a long background. Such units offer the viewer the psychological satisfaction of removing the noxious noise by simply pointing and pulling the trigger.

Pistol shaped remote control units have a further utility especially applicable to the visually impaired and to use in buildings or rooms with darkened interiors. The pistol grip makes the location and function of certain controls easy to remember and easy to identify by mere tactile sensation. As long as the device can be pointed in the proper direction, as even the visually impaired may do if only by sound, it can prove relatively quick and convenient to grasp the pistol shaped remote control and operate the proper switch with one hand by its location relative to the grip.

The number of differently designed pistol shaped remote control devices known is some measure of the fact that the proper number and configuration of switches has not been finally determined. The present invention provides a different and alternative arrangement of switches on a pistol shaped remote control unit which presents a more convenient and ergonomic arrangement of controls for the user.

None of the above inventions and patents, taken either singularly or in combination, is seen to describe the instant invention as claimed. Thus an ergonomic remote control solving the aforementioned problems is desired.

SUMMARY OF THE INVENTION

The present invention is a remote control unit having the shape of a pistol. The unit includes an infrared light emitting diode (LED) and circuitry for transmitting control signals to an infrared detector and appropriate circuitry in a television or video cassette recorder receiver. The unit includes a microprocessor which retains a preselected number of channels in memory. The ergonomic design provides a plurality of conveniently activated switches, including a trigger which changes the channel to the last channel previously selected and three volume control switches on the front of the grip (volume up, down and mute) for convenient operation by the index, middle and ring fingers, respectively. The power switch is located at the back of the grip on an angled portion of the housing separating the function keyboard from the hammer, which projects above the barrel and houses the infrared transmitter. Power to the unit is provided by batteries which are loaded into the barrel of the device by means of a threaded cap at the muzzle. In a first embodiment, the remote control has a function keypad on the back of the grip and picture adjustment buttons of the side of the grip. In a second embodiment, the remote control has a first keypad with function controls for a television on one side of the grip, a second keypad with function controls on the other side of the grip, and buttons for enabling and disabling the two keypads adjacent the hammer.

Advantageously, the unit places the power and volume control switches in locations where they are immediately recognized by touch alone, providing a convenient and easily operated device for operation in the dark, or by the visually impaired. The coupling of the trigger to changing the channel to a channel retained in memory provides the user with a quick and satisfactory method of changing viewing from an annoying television program or advertising commercial. The combination of the feel of the revolver with function is particularly satisfying in cultures which have a long history of use and possession of firearms. Hence, the unit provides utility where vision is a problem, and offers a psychologically satisfying means for terminating viewing of offending programming.

Accordingly, it is a principal object of the invention to provide a television remote control unit which provides a quick means of switching viewing channels to avoid annoying or offensive programming in the form of pulling the trigger of a pistol shaped control unit.

It is another object of the invention to provide a television remote control unit which may easily be operated when vision is impaired by placing buttons and switches in easily remembered locations of a pistol shaped housing.

It is a further object of the invention to provide the user of a television remote control unit with a device combining functional utility with aesthetic satisfaction in the form of a pistol shaped remote control unit.

Still another object of the invention is to provide a remote control device for both a television receiver and a video cassette recorder combined into an ergonomic pistol shaped housing.

Another object of the invention is to provide a remote control which may be used intuitively, i.e., it is not necessary to look at the remote control when using it, as the most frequently used key functions are readily available when holding the unit.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
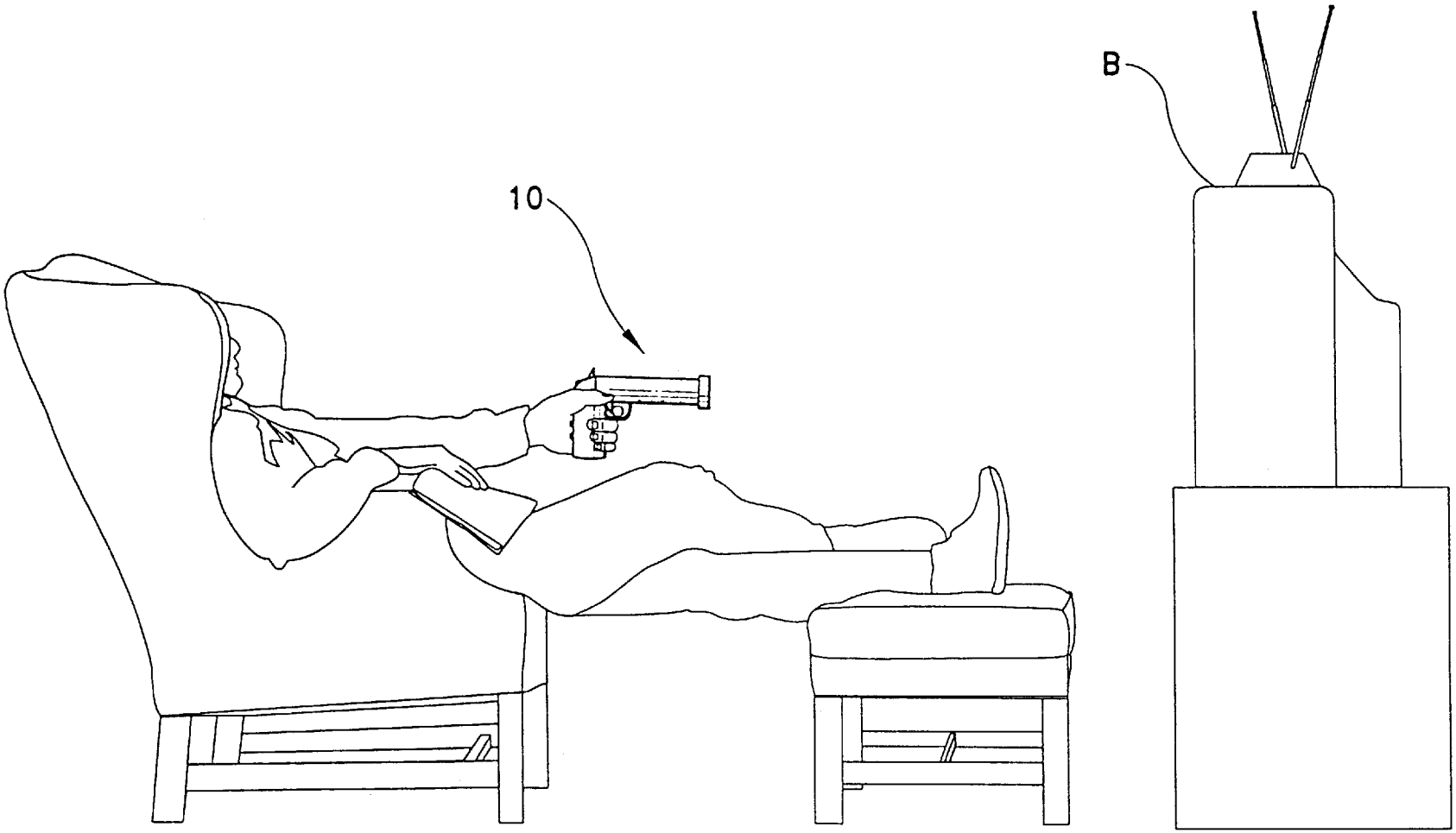
FIG. 1 is an environmental perspective view of an ergonomic remote control according to the present invention.
Figure 2:
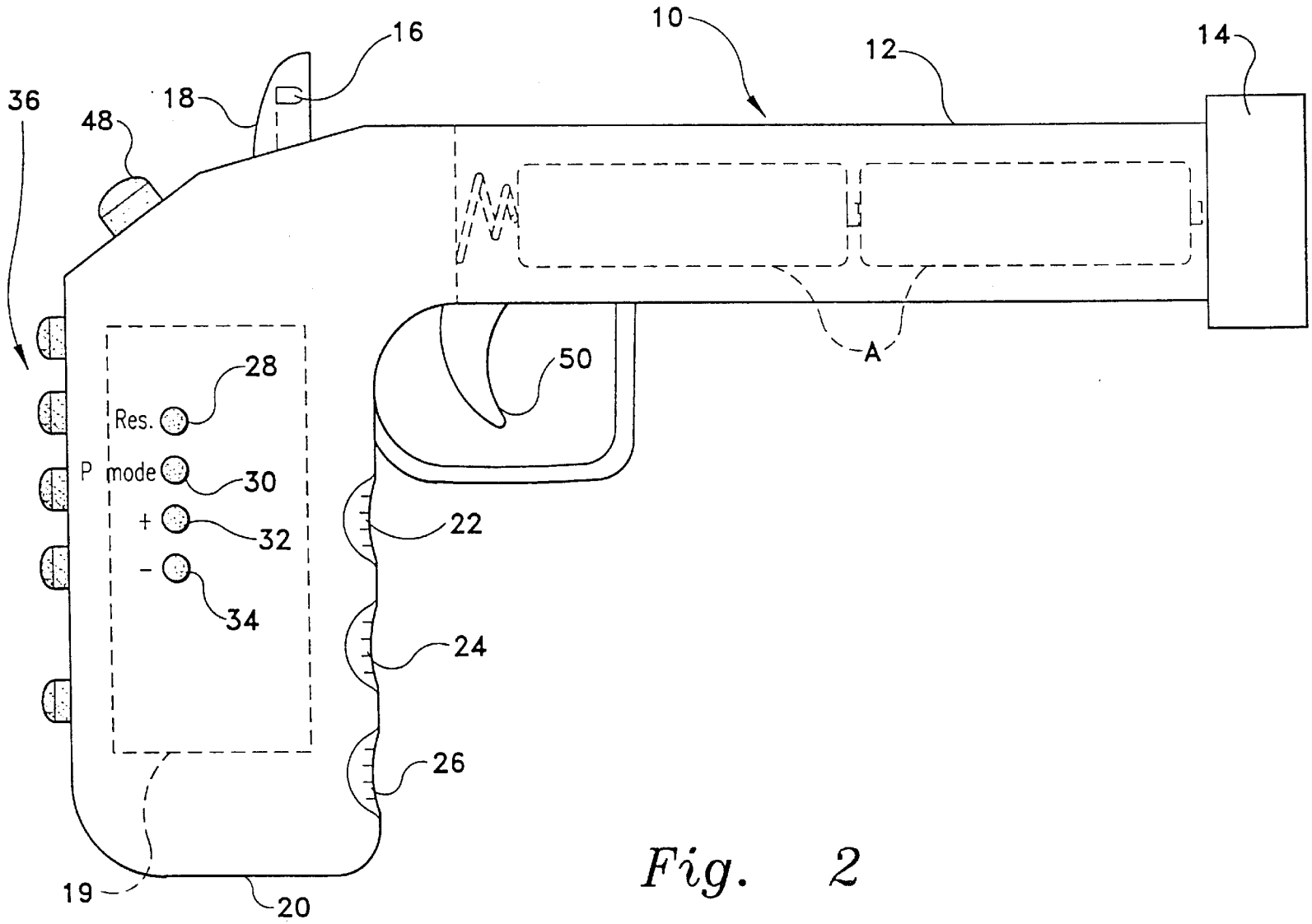
FIG. 2 is an elevational view of an ergonomic remote control according to the present invention.
Figure 3:
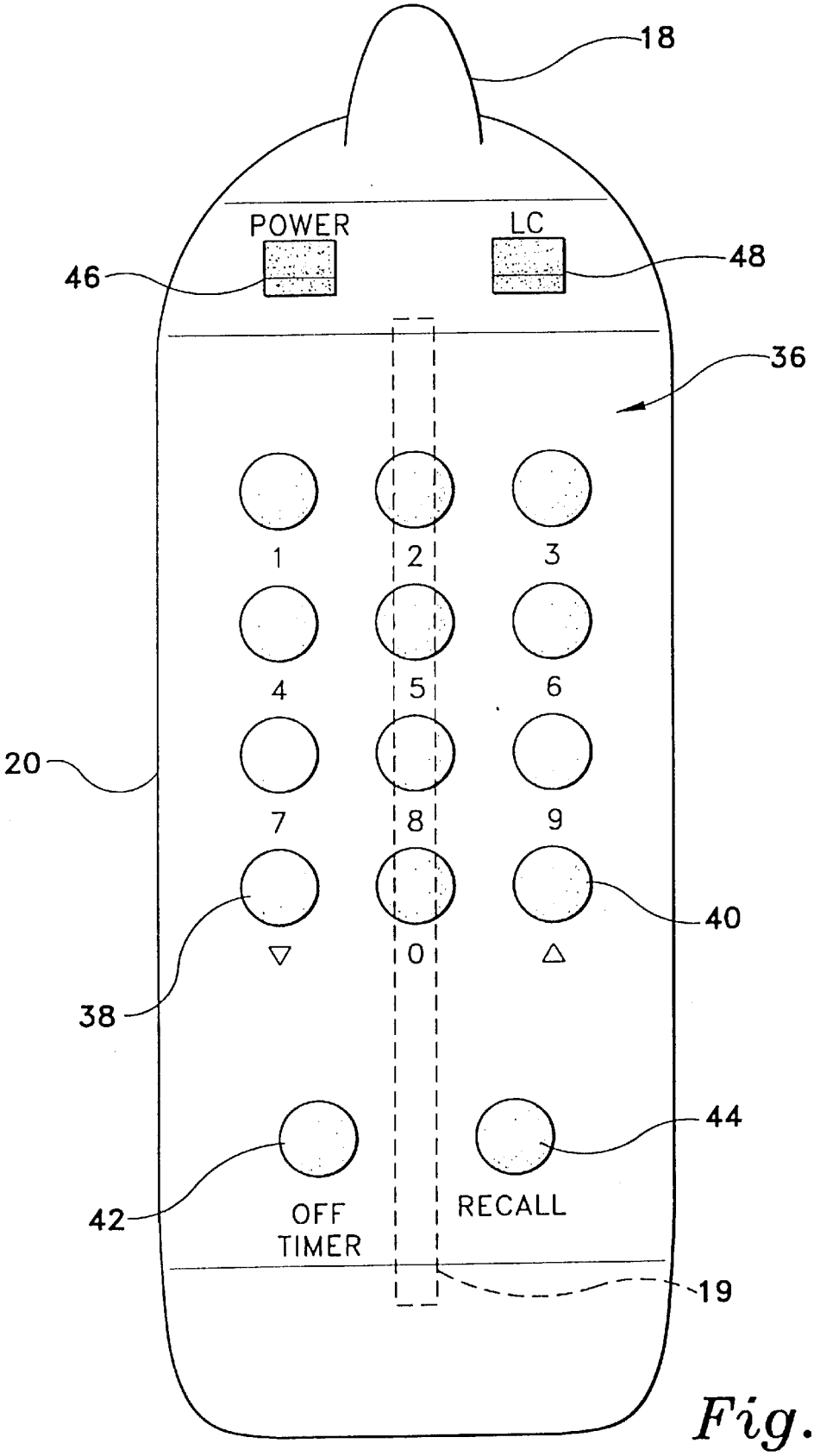
FIG. 3 is an end view of an ergonomic remote control according to the present invention as seen from the grip end.

The present invention is shown in FIGS. 1, 2 and 3. The ergonomic remote control unit, designated generally as 10, has a housing shaped like an automatic pistol. The power supply for the device consists of batteries A which are inserted into the barrel 12 of the unit through a threaded cap 14 at the muzzle end of the unit 10. The infrared light emitting diode (LED) transmitter 16 is housed in the hammer 18 of the unit, which projects above the level of the barrel 12. The front and rear sights have been removed from the gun to leave a clear path for transmission of control signals from the unit 10 to a television receiver B. The circuitry 19 for the unit 10 is contained inside the grip 20. The circuitry 19 is of a conventional type well known in the industry and therefore not shown, but may be described as generally including a microprocessor control to accept and decode commands from the switches, provide memory for the last six channels selected by the user, and generate an appropriate binary coded signal correlated with commands entered by the user, and driver circuitry to drive the infrared transmitter 16, all of this circuitry being well known in the television electronics industry.

As shown in FIG. 2, the front edge of the grip 20 is contoured, having a plurality of concave grooves or finger depressions, each containing a switch. The top depression contains a switch 22 having a concave face appropriate for operation by an index or middle finger curled around the grip 20, and preferably is a volume up control for increasing the volume of the television set, which may be continuously adjustable, or which may be adjustable in steps. Similarly, the middle depression contains a volume down switch 24 for decreasing television volume, and is situated for convenient operation by the middle or ring finger curled around the grip 20. The bottom depression, which may be operated by either a ring finger or little finger curled around the grip 20, contains a mute switch 26 for muting the volume of the television.

The side of the grip 20 exhibits a plurality of button switches for adjusting the quality of the picture. As shown in FIG. 2, the unit 10 includes a control for adjusting the picture resolution 28, a picture mode button 30 for toggling the picture adjustment between brightness, color, and hue, and buttons for increasing 32 or decreasing 34 the adjustment for the selected picture mode.

The unit 10 includes a special function keypad 36 on the back of the grip 20 as shown in FIG. 3. The keypad 36 has a four by four matrix of buttons for direct entry of the desired viewing channel and for channel up and channel down functions, arranged from left to right as follows: first row, "1", "2", "3"; second row, "4", "5", "6"; third row, "7", "8", "9"; fourth row, a down arrow 38 for channel down, "0", and an up arrow 40 for channel up. Below the matrix are two buttons, labelled "Off Timer" 42 for toggling a timer which turns the television on and off at preset times, and "Recall" 44 for toggling the display of settings on the screen.

Above the keypad 36, the housing angles forward from the top of the grip 20 to the bottom of the hammer 18. Two switches are mounted on the slope of the housing, a power switch 46 for toggling power to the television set on and off, and a last channel switch 48 for switching to the previous channel, both of which are capable of being operated by the thumb.

The trigger 50 of the unit 10 is a switch which changes the channel of the television set in the order of the last six television channels selected, from last to first. If desired, the viewer may preset the memory by entering the six desired channels in sequence, or by repeating a sequence of three channels, or any other desired combination.

Figure 4:
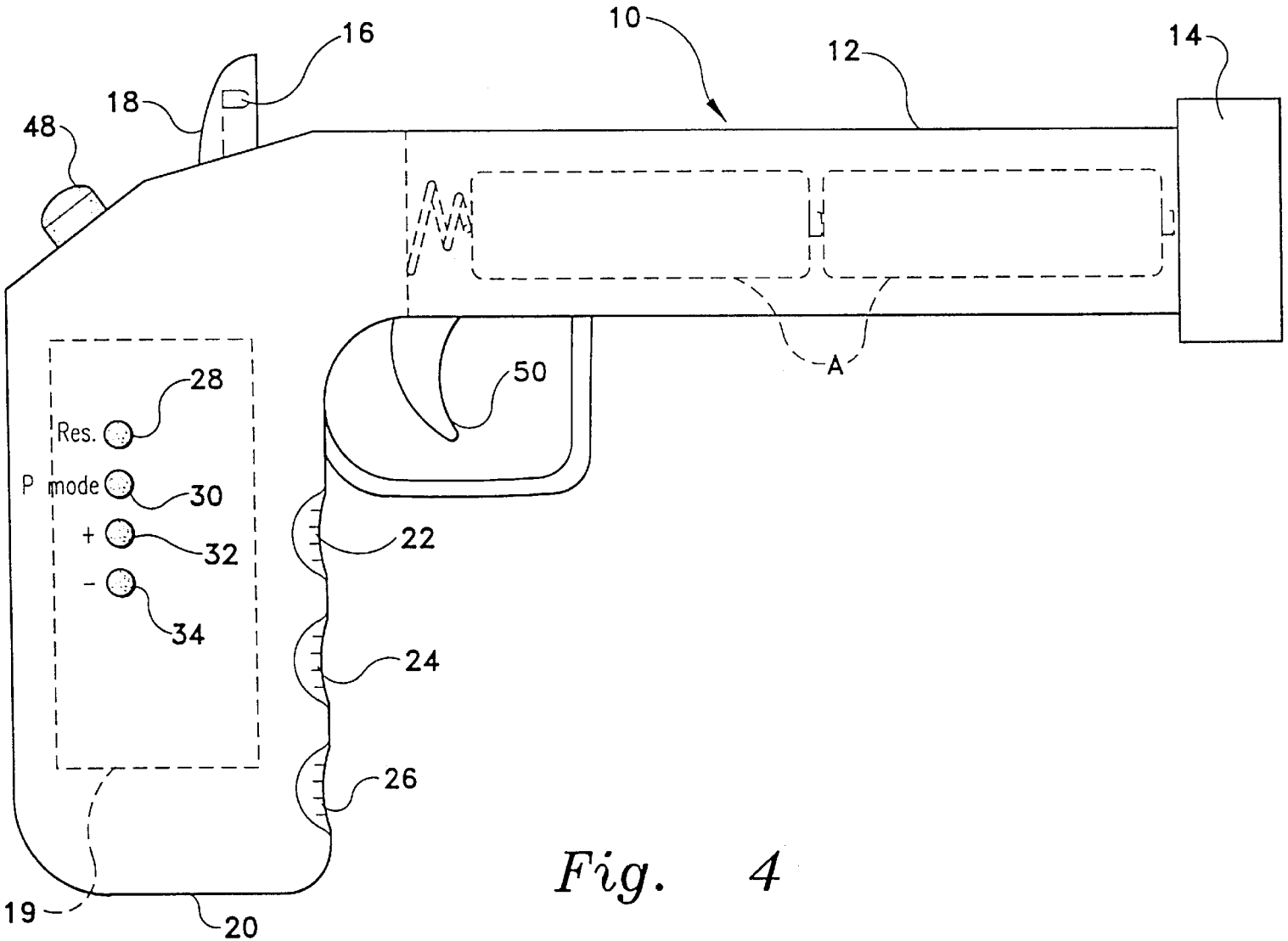
FIG. 4 is an elevational view of an alternative embodiment of the ergonomic remote control according to the present invention.
Figure 5:
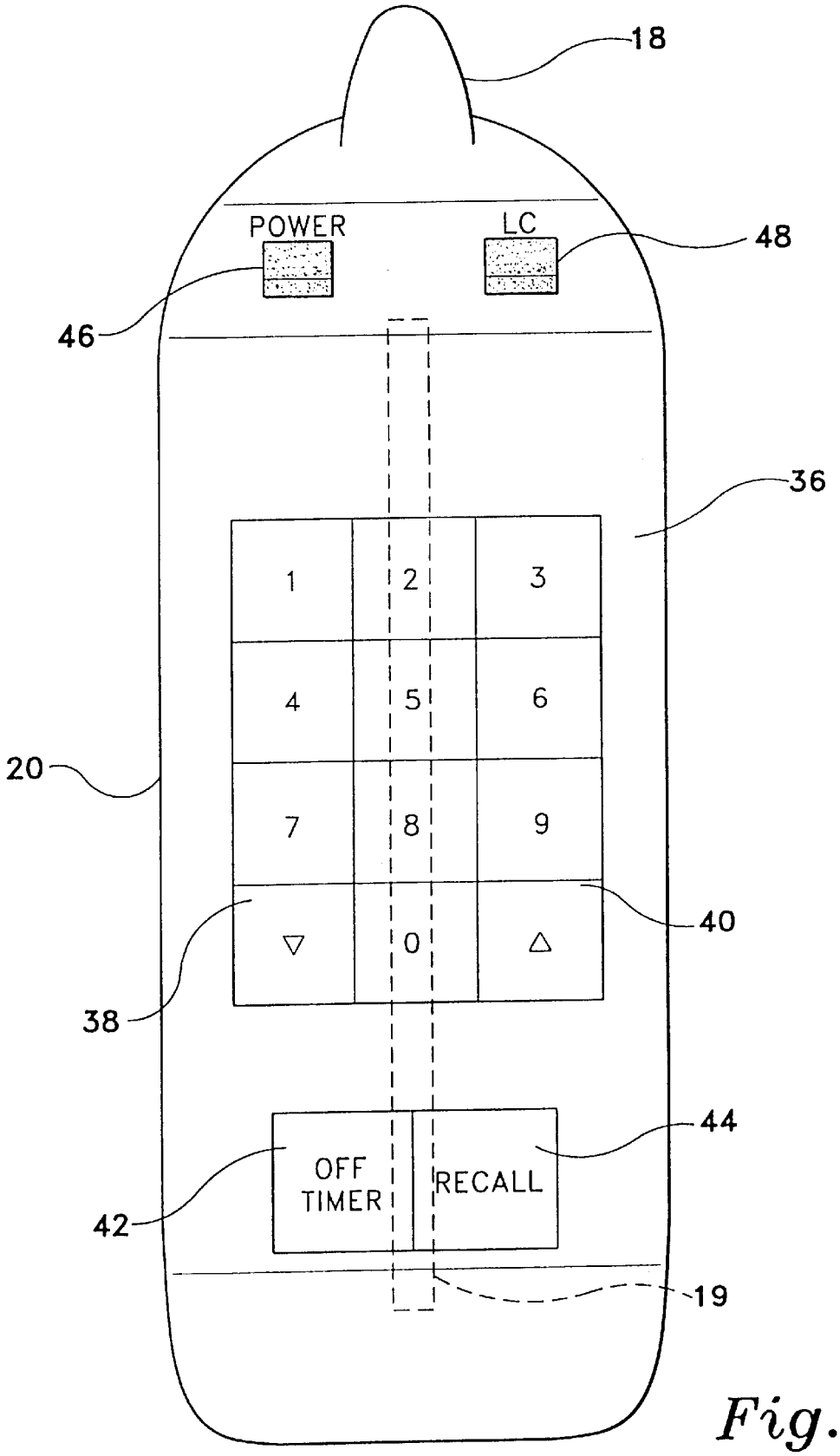
FIG. 5 is an end view of the embodiment of the ergonomic remote control shown in FIG. 4 according to the present invention as seen from the grip end.

As shown in FIGS. 2 and 3, the keypad 36 buttons project from the back surface of the grip 20 somewhat, and therefore could accidentally be triggered by pressure from the palm of the hand when gripping the unit 10. FIGS. 4 and 5 show an alternative embodiment of the invention in which the keypad 36 is recessed into the back of the grip 20 to prevent accidental triggering of the controls. In this alternative embodiment, the keypad 36 may be covered with a vinyl or plastic pad, similar to keypads used for automatic teller machines in the banking industry.

The manner of using the unit 10 is fairly intuitive. The unit 10 is grasped by the grip 20 with the fingers curled around the knurls 22, 24, and 26. The device is pointed or aimed at the television set so that infrared LED 16 can transmit control signals to the television set B. Power to the set is turned on by switch 46. The channel may be set using keypad 36 for direct entry. Volume is controlled by switches 22, 24, and 26 and picture quality by switches 28, 30, 32, and 34. When the program on the television is particularly annoying or irksome, the program may be "zapped" by pulling the trigger 50 to change the channel to the previous channel watched, which may be repeated to view up to six channels. The light path from the LED 16 to the television B may be partially blocked by barrel 12, but this is not though to be significant and is easily remedied by depressing barrel 12 when aiming at the television set B.

It will be obvious that various modifications may be made to the ergonomic remote control unit 10 without departing from the essence of the invention. For example, the control circuitry may be placed in the barrel 12 housing instead of the grip 20. In that event, the batteries A might be loaded in the grip 20, perhaps in a sliding mechanism mounted in the base of the grip 20 to simulate loading the magazine of an automatic pistol. Another obvious variation might be to link the trigger 50 to the power switch 46, so that when the trigger 50 is pulled, the television set B is turned off, often a more definitive and satisfying solution to eliminating unwanted noise from the television B. A third variation is to mount the infrared LED 16 at the muzzle end of the barrel 12; however, it is preferred to mount the transmitting LED 16 in the hammer housing to avoid damage to the lens of the LED in the event the unit 10 is dropped on a hard surface.

Figure 6:
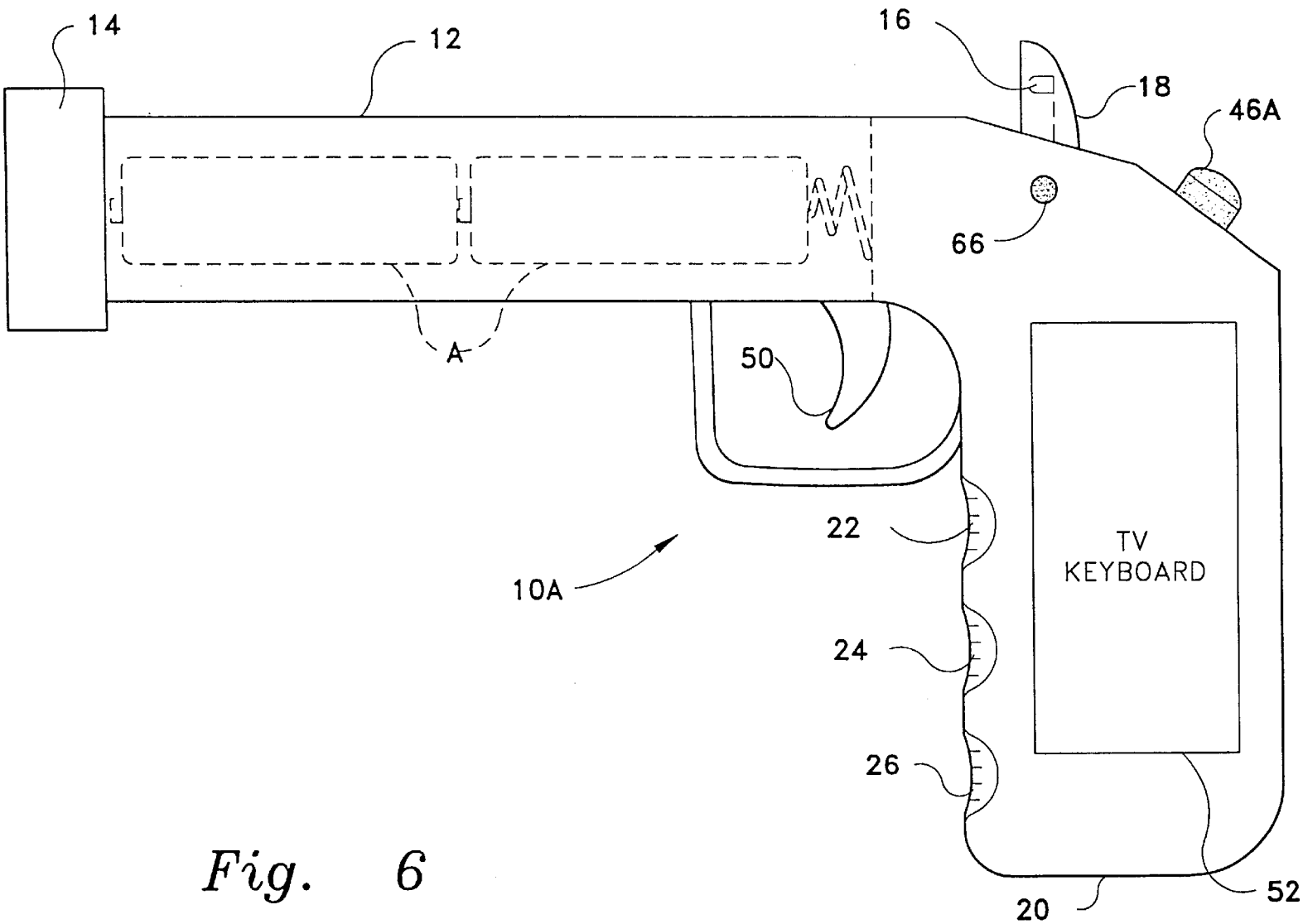
FIG. 6 is a elevational view of the left side of another alternative embodiment of an ergonomic remote control according to the present invention.
Figure 7:
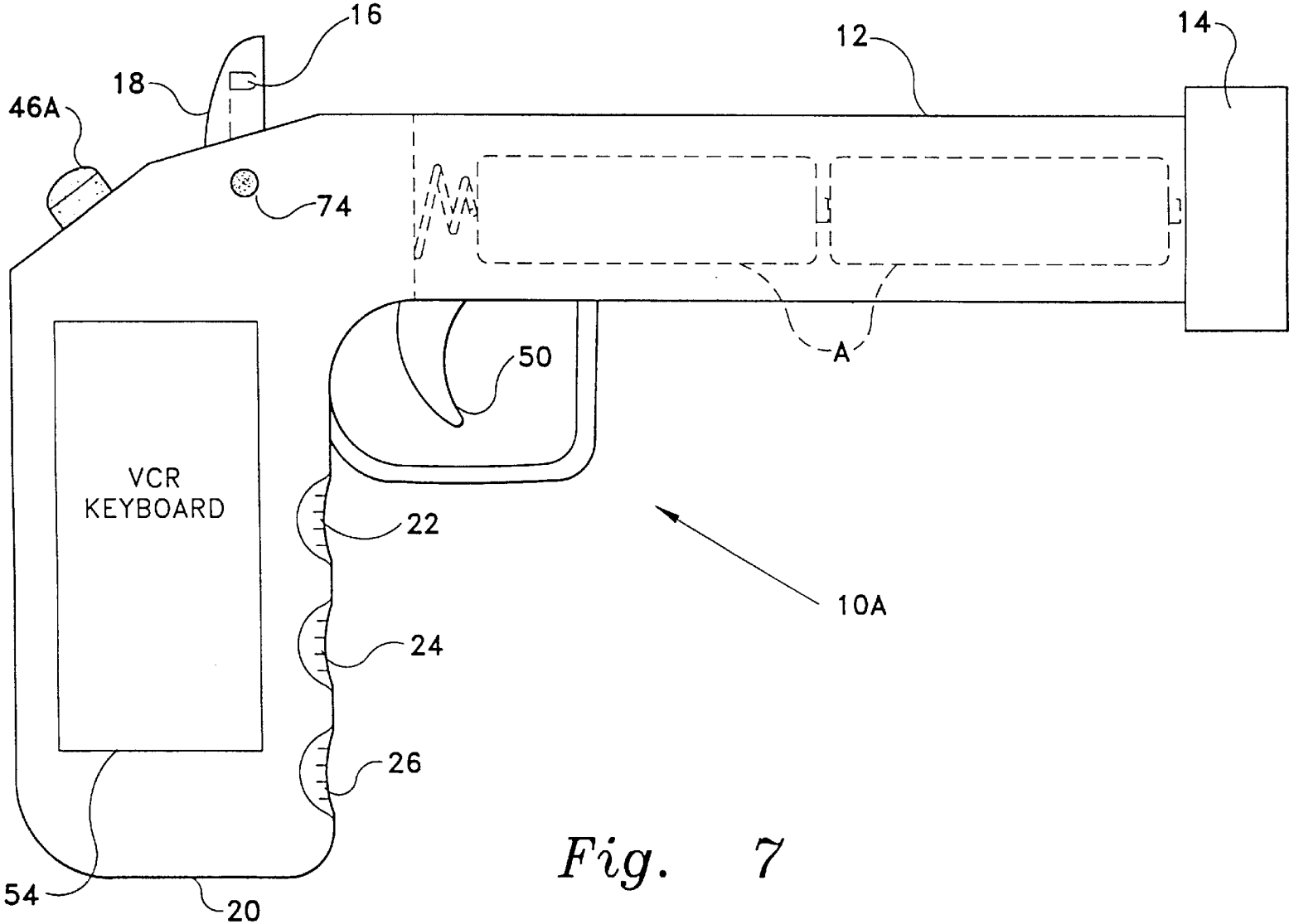
FIG. 7 is a elevational view of the right side of the embodiment of an ergonomic remote control shown in FIG. 6 according to the present invention.
Figure 8:
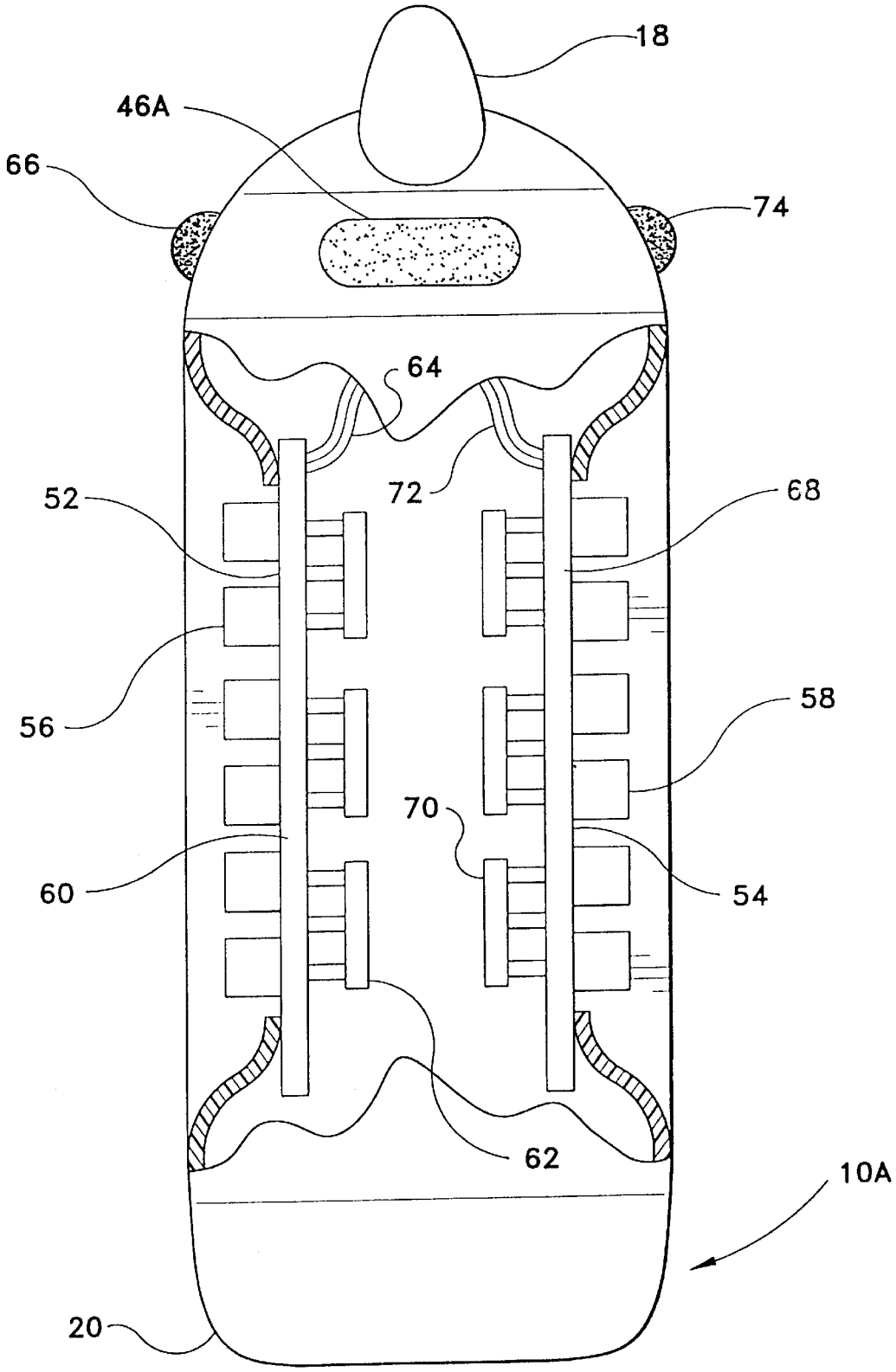
FIG. 8 is an end view of the embodiment of the ergonomic remote control shown in FIG. 6 according to the present invention as seen from the grip end with the grip broken away.

A preferred embodiment of the ergonomic remote control is shown in FIGS. 6–8. In this embodiment, a remote control for a television receiver and a video cassette recorder are combined in the same housing. The structure of the remote control unit 10A shown in FIGS. 6, 7 and 8 is similar to the above embodiments, including a hollow barrel 12 containing a battery power source A accessed by a cap 14 at the muzzle end, an infrared emitter 16 in the hammer housing 18, and volume up 22, volume down 24, and mute 26 switches on the front face of the grip 20. The trigger 50 and the power on/off switch 46 perform the identical functions described above.

However, in this embodiment the unit 10A has a first keypad 52 recessed into one side of the grip 20, and a second keypad 54 recessed into the opposite side of the grip 20. The first keypad 52 contains a plurality of buttons 56 for controlling television receiver functions, such as channel selection, picture controls (e.g., brightness, contrast, etc.), and other functions normally entered directly into the television receiver. The exact number of buttons 56, their layout, and the number of television receiver functions which may be accessed by the remote control unit 10A are not critical, and are therefore shown diagrammatically in FIG. 6. The keypad 52 is attached to a first printed circuit board 60 having conventional electrical circuitry and components 62 thereon, as is known in the electrical arts, for converting the selected function into an electrical signal for driving the infrared emitter 16. The circuitry 62 may be electrically connected to the power source A by wiring 64 or other electrical bus or conductor means. Since the keypad 52 is recessed, accidental keying of the buttons 56 is minimized. However, in this embodiment, a toggle switch 66 for enabling and disabling the keypad 52 is mounted on a portion of the housing adjacent the hammer housing 18, the location of the keypad enablement switch 66 being an area unlikely to be handled while grasping the unit 10A by the grip 20. With the keypad enablement switch 66 in the disabling position, the keypad 52 cannot be accidentally keyed while grasping the unit 10A by the grip 20 in order to adjust the volume with switches 22, 24 and 26 or change the channel with trigger 50.

Similarly, the second keypad 54 contains a plurality of buttons 58 for controlling the functions of a video cassette recorder (VCR). The VCR may be integral with the television receiver, or it may be housed in a separate unit. The keypad 54 is attached to a second printed circuit board 68 having conventional electrical circuitry and components 70 thereon, as is known in the electrical arts, for converting the selected function into an electrical signal for driving the infrared emitter 16. The circuitry 70 may be electrically connected to the power source A by wiring 72 or other electrical bus or conductor means. Since the keypad 54 is recessed, accidental keying of the buttons 58 is minimized. A toggle switch 74 for enabling and disabling the keypad 54 is mounted on a portion of the housing adjacent the hammer housing 18 on the opposite side from toggle switch 66, the location of the keypad enablement switch 74 being an area unlikely to be handled while grasping the unit 10A by the grip 20. The toggle switches 66 and 74 may be illuminated switches or detent switches of a type known in the art in order to permit ready ascertainment of the enablement status of the keypads 52 and 54 by sight or touch. Use of the remote control unit 10A is the same as described above.

It is to be understood that the present invention is not limited to the embodiments described above, but encompasses any and all embodiments within the scope of the following claims.

We claim:

1. An ergonomic remote control unit adapted for being held by a human hand and being manipulated by the digits of the hand, for the remote control of a television set and a video cassette recorder, the remote control unit comprising:

a) a housing substantially shaped like a pistol having a grip, a barrel, and a hammer, the hammer projecting above the barrel;

b) an infrared transmitting light emitting diode housed in said hammer for transmitting control signals to a television set and to a video cassette recorder;

c) a first keypad having a plurality of control switches for controlling the functions of a television set, the first keypad being mounted in a recess on a first lateral side of said grip;

d) a second keypad having a plurality of control switches for controlling the functions of a video cassette recorder, the second keypad being mounted in a recess on a second lateral side of said grip;

e) an electrical circuit contained within said housing capable of encoding signals from said plurality of control switches into binary control signals and for driving said diode to transmit the control signals; and f) a power supply mounted within said housing for supplying power to said circuitry and said diode;

g) a first enablement switch for enabling and disabling said first keypad, the first enablement switch being mounted on said housing between said grip and said hammer; and h) a second enablement switch for enabling and disabling said second keypad, the second enablement switch being mounted on said housing between said grip and said hammer.

2. The ergonomic remote control unit according to claim 1, wherein:

a) said electrical circuit is adapted for retaining a plurality of signals in memory corresponding to a sequence of television channels; and b) said plurality of control switches further comprises a trigger switch adapted for being pulled by the index finger, the switch being for signaling a change in the television channel.

3. The ergonomic remote control unit according to claim 1, wherein the grip includes a plurality of switches, each switch having a concave face adapted for receiving the fingers of the hand, said plurality of switches on said grip including:

a) a switch for increasing the volume of sound from the television set;

b) a switch for decreasing the volume of sound from the television set; and c) a switch for muting the sound from the television set.

4. The ergonomic remote control unit according to claim 1, wherein said plurality of control switches includes a power switch mounted between said grip and said hammer for switching the power of the television set.

5. The ergonomic remote control unit according to claim 1, wherein said unit further comprises a threaded cap removably engaging said barrel and wherein said power supply comprises at least one battery inserted into the barrel by removing said cap from said barrel, inserting said at least one battery into said barrel, and engaging said threaded cap onto said barrel.

* * * * *